US009155394B1

(12) United States Patent
Cohen

(10) Patent No.: US 9,155,394 B1
(45) Date of Patent: Oct. 13, 2015

(54) CHAIR WITH SLIDE-OUT LEG REST

(71) Applicant: Joshua Cohen, Toronto (CA)

(72) Inventor: Joshua Cohen, Toronto (CA)

( * ) Notice: Subject to any disclaimer, the term of this patent is extended or adjusted under 35 U.S.C. 154(b) by 0 days.

(21) Appl. No.: 14/506,295

(22) Filed: Oct. 3, 2014

(51) Int. Cl.
*A47C 20/00* (2006.01)
*A47C 7/50* (2006.01)
*A47C 5/00* (2006.01)

(52) U.S. Cl.
CPC .. *A47C 7/506* (2013.01); *A47C 5/00* (2013.01)

(58) Field of Classification Search
CPC ..... A47C 7/50; A47C 7/506; A47C 1/037; A47C 1/04; B60N 3/063
USPC ..... 297/423.2
See application file for complete search history.

(56) References Cited

U.S. PATENT DOCUMENTS

| | | | | | |
|---|---|---|---|---|---|
| 488,095 | A | | 12/1892 | Scott et al. | |
| 512,204 | A | * | 1/1894 | Miles | 297/313 |
| 864,289 | A | | 8/1907 | Calef | |
| 1,125,167 | A | * | 1/1915 | Pepper | 297/320 |
| 2,480,300 | A | * | 8/1949 | Luketa | 297/423.2 |
| 2,509,451 | A | | 5/1950 | Reinholz | |
| 2,545,679 | A | * | 3/1951 | St Germain | 297/423.2 |
| 3,007,738 | A | * | 11/1961 | Gardel et al. | 297/423.2 |
| 3,295,885 | A | * | 1/1967 | Barksdale | 297/84 |
| 3,342,445 | A | | 9/1967 | Bouwkamp | |
| 3,794,381 | A | * | 2/1974 | Caldemeyer | 297/423.22 |
| 4,251,106 | A | | 2/1981 | Gilbert | |
| 4,314,576 | A | | 2/1982 | McGee | |
| 4,364,603 | A | * | 12/1982 | Johnson | 297/84 |
| 4,784,436 | A | | 11/1988 | Sutherland | |
| 5,180,208 | A | | 1/1993 | Lawandi | |
| 5,333,818 | A | * | 8/1994 | Brandt et al. | 244/118.6 |
| 5,505,519 | A | * | 4/1996 | Natt | 297/250.1 |
| 6,076,893 | A | * | 6/2000 | Brotherston | 297/423.35 |
| 6,145,931 | A | * | 11/2000 | Subotic | 297/423.2 |
| 6,354,657 | B1 | | 3/2002 | Nelson et al. | |
| 6,811,225 | B1 | * | 11/2004 | Konya et al. | 297/423.13 |
| 6,921,135 | B2 | | 7/2005 | Ellis et al. | |
| 6,935,962 | B1 | * | 8/2005 | Tseng | 472/125 |
| 7,540,567 | B1 | * | 6/2009 | Gambino | 297/344.26 |
| 7,621,599 | B2 | * | 11/2009 | Whalen | 297/423.21 |
| 2004/0189074 | A1 | * | 9/2004 | Seki et al. | 297/423.1 |

FOREIGN PATENT DOCUMENTS

| | | | | |
|---|---|---|---|---|
| EP | 2745743 | * | 6/2014 | A47C 31/008 |

* cited by examiner

*Primary Examiner* — Laurie Cranmer
(74) *Attorney, Agent, or Firm* — Millman IP Inc.

(57) ABSTRACT

A chair having a retractable leg rest connected to at least one of the chair seat and legs. The leg rest includes spaced-apart telescoping members that are orientated in a plane transverse to the legs. A fabric extends between the telescoping members. The telescoping members are extensible along the third plane to extend and retract the fabric relative to the seat, upon which the user's legs may rest when the fabric is extracted.

13 Claims, 3 Drawing Sheets

CHAIR WITH SLIDE-OUT LEG REST

FIELD OF INVENTION

The invention relates to furniture arts.

BACKGROUND OF INVENTION

Chairs with footrests are well known. Sometimes these are separate pieces and other times they may be integrated with the chair. The conventional integrated sofa foot rest is articulated to the seat and in the retracted position lies in a vertical orientation. When the footrest is deployed the back swivels and the footrest swings out to approach or reach a horizontal position. Such an assembly involves a relatively complicated construction. An alternative, less costly construction is desired, particularly for easily portable chairs.

SUMMARY OF INVENTION

In an aspect, a chair is provided which includes a seat disposed generally along a first plane; legs, connected to the seat, which are disposed in at least two second planes orientated generally transverse to the first plane; and a retractable leg rest connected to at least one of the seat and legs. The leg rest includes at least two spaced-apart telescoping members, which are orientated in a third plane transverse to the at least two second planes, and a fabric, which extends between the spaced aprt telescoping members. The telescoping members are extensible along the third plane to extend and retract the fabric and hence the leg rest relative to the seat.

The third plane along which the telescopic members lie can be orientated substantially parallel to the first plane.

Each telescoping member may include a tubular base portion and at least one extensible member slidably received therein. The tubular base portion and the extensible member may be coupled together via a lost motion connection. The lost motion connection can be provided by a slot in one of the tubular base portion and the extensible member and a pin connected to the other of the tubular base portion and the extensible member, said pin being captive in said slot. For example, the tubular base portion can have an elongate slot and the extensible member can have a thumbscrew operatively connected thereto that rides in the elongate slot.

The telescopic members can each have multiple nested extensible members.

The base portions of the telescopic members can be fixed to at least one of the seat and legs such that the base portions are disposed substantially under the seat with the extensible members being substantially retractable into the corresponding base portions such that the leg rest stows substantially under the seat when in a retracted position.

In one embodiment the fabric can be partially slidable over the extensible members. The fabric has a proximate end adjacent the seat and a distal end remote from the seat. The fabric distal end can be fixed to a distal end of the extensible member and the fabric proximate end can be connected to a stationary portion of the chair via a flexible member. The fabric can also includes sleeves that contain the extensible members. The fabric may scrunch up when the extensible members are retracted and the fabric may spread out when the extensible members are extracted.

In another embodiment the fabric can be fixed to the extensible members. In this case the tubular base portion can includes a channel for accommodating the fabric when the extensible member is retracted.

In some embodiments the tubular portions of the telescoping members can be provided by a seat frame.

In some embodiments the telescoping members can be at least partially spaced apart from the seat and inclined relative thereto

BRIEF DESCRIPTION OF DRAWINGS

The foregoing and other aspects of the invention will be more readily appreciated having regard to the attached drawings, wherein.

DETAILED DESCRIPTION OF EXAMPLE EMBODIMENTS

Figure 1:
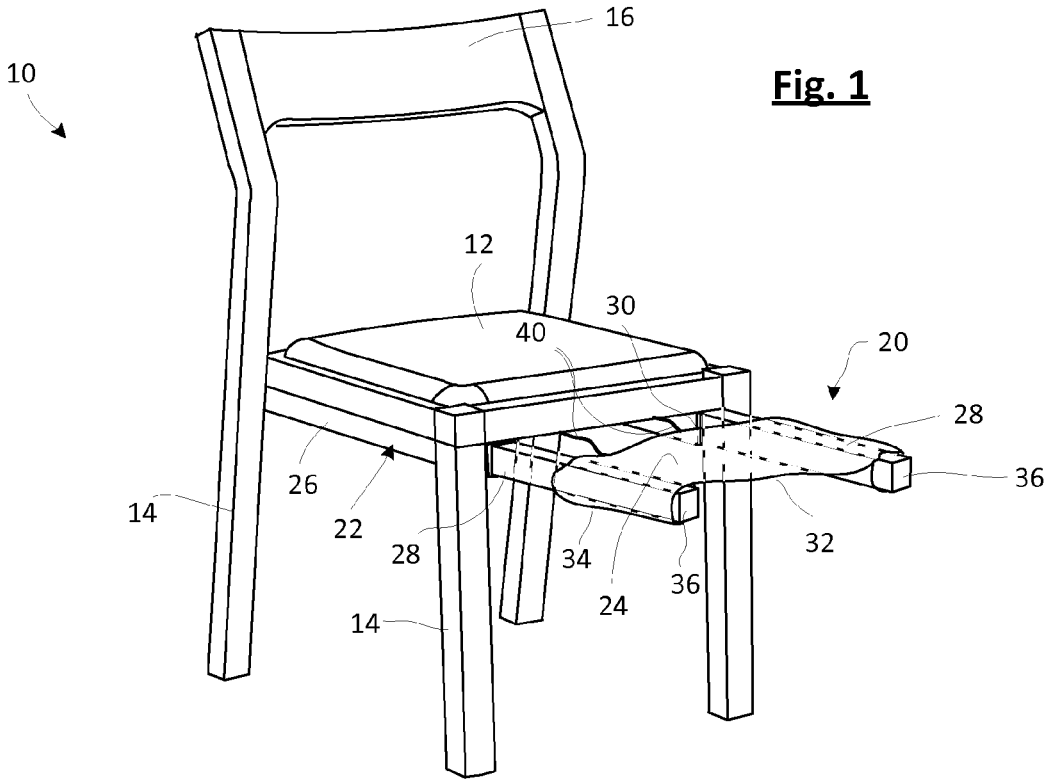
FIG. 1 is an perspective view of a chair with a leg rest in an extended position, according to a first embodiment.
Figure 2:
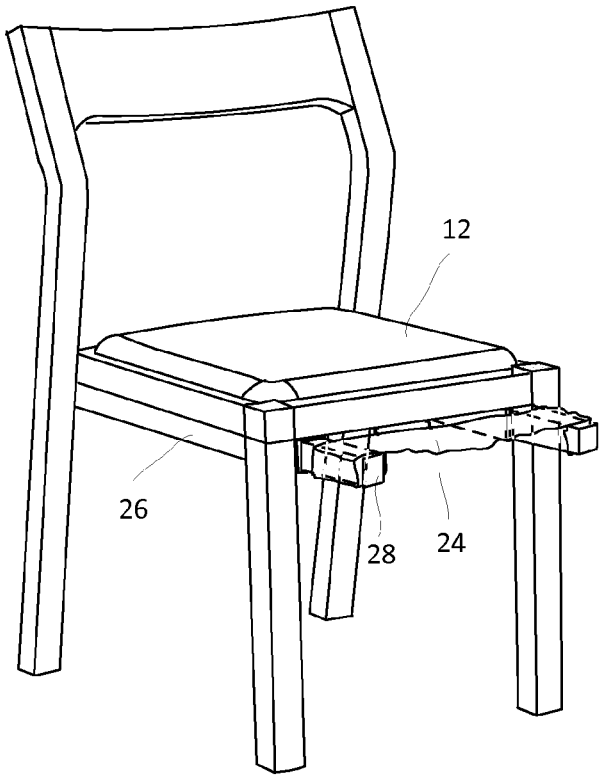
FIG. 2 is a side view of the chair shown in FIG. 1.
Figure 3:
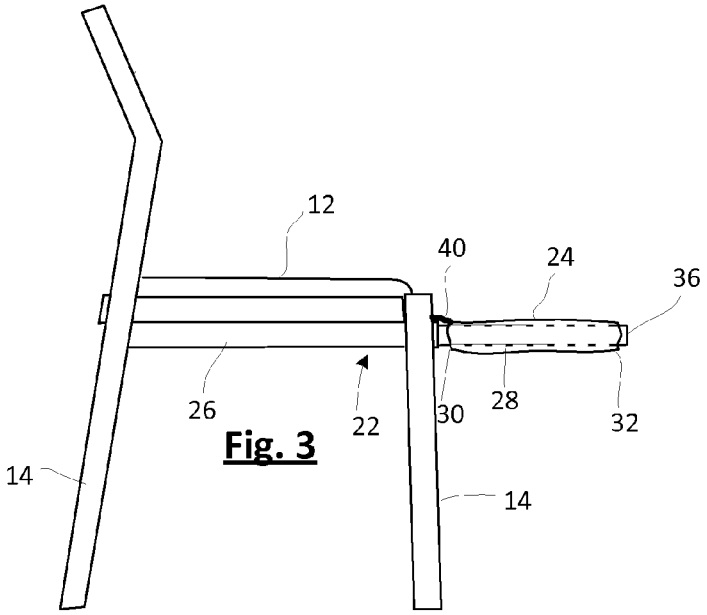
FIG. 3 is an isometric view of the chair according to a first embodiment with the leg rest in a retracted position.

FIGS. 1-4 show a chair 10 with a retractable leg rest 20 according to a first embodiment. FIGS. 1 and 3 show isometric and side views, respectively, of the chair with the retractable leg rest 20 in an extended position. FIGS. 1 and 3 show isometric and side views, respectively, of the chair with the retractable leg rest 20 in a retracted position.

The chair 10 includes a conventional seat 12, legs 14 and a back 16. The seat 12 is situated generally along a first plane. The legs 14, which are connected to the seat 12, are disposed in two second planes orientated generally transverse to the first plane. In FIG. 1 the legs 14 are situated in two parallel planes but as will be seen in FIG. 7, which shows a folding chair 100, the legs 14 can be situated in two (or more) non-parallel planes.

The retractable leg rest 20 includes two spaced apart telescoping members 22 with a fabric 24 extending between the telescoping members 22. Each telescoping member 22 has a tubular base portion 26 that is fixed to the seat 12 and/or legs 14 and at least one extensible portion 28 that is slidably received in the tubular base portion 26 so as to extend from and retract into the tubular base portion 26. The telescoping members 22 are disposed along a third plane that lies transverse to the two second planes and, in this embodiment but not necessarily in other embodiments, parallel to the first plane.

Figure 5:
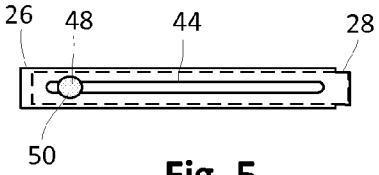
FIG. 5 is a plan view of a telescoping member, in isolation, employed in the leg rest of the first embodiment.

The extensible portion 28 is retained in the tubular base portion 26, that is, when fully constructed the extensible portion 28 cannot be completely separated from the tubular base portion 26. This may be provided by a lost motion connection such as shown in the partial bottom view of FIG. 5, wherein the tubular base portion 26 features an elongate slot 44 and the extensible portion 28 includes captive pin 48 (having a head wider than the slot width) so as to allow the extensible portion 28 to slide a pre-defined distance relative to the tubular base portion 26. In practice, the extensible portion 28 may include a threaded hole and a thumbscrew 50 which is installed in the threaded hole, thus functioning as the captive pin. The thumbscrew 50 provides a releasable locking mechanism that allows the user to tighten or loosen the extensible portion 28 against the tubular base portion 26 and maintain the leg rest 20 in either the retracted or extended position or indeed in any intermediate position. If desired, the slot/thumbscrew may be disposed along an outwardly facing side of the telescoping member 22 for ease of access.

The fabric 24 has a proximate end 30 near the seat 12 and a distal end 32 remote from the seat 12. In the illustrated embodiment the peripheries of the fabric 24 are formed with sleeves 34 extending between the proximate and distal ends 30, 32 which contain the extensible portions 28. The distal end 32 of the fabric 24 is fixed to distal ends 36 of the extensible portions 28. Any suitable fastener may be used to fix the fabric 24 to the distal ends 36 of the extensible portions 28 such as nails, screws, adhesives, hook and look fasteners. The proximate end 30 of the fabric 24 is attached to one end of one or more flexible members 40, such as rope, wires or chains. The other ends of the flexible members 40 are connected to a stationary part of the chair such as the seat 12, as shown, legs 14 or tubular base portion 26. With this construction the fabric 24 is partially slidable over the telescopic members 22.

In operation the leg rest 20 can be manually moved between the retracted and extended positions.

Figure 4:
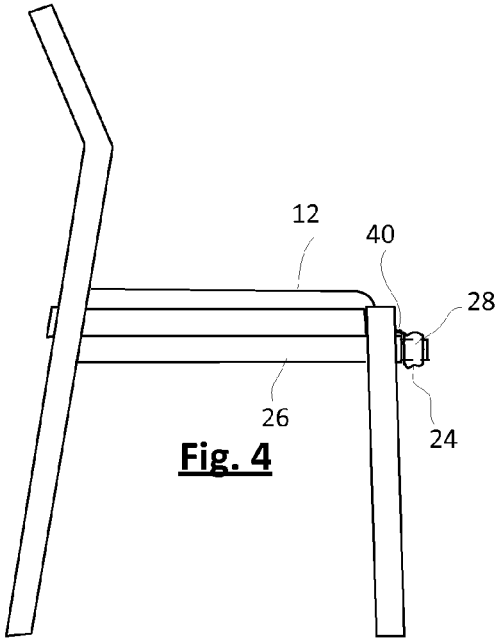
FIG. 4 is a side view of the chair shown in FIG. 3.

In the retracted position the leg rest 20 and more particularly the extensible members 28 stow substantially under the seat 12. The fabric 24, being attached at its distal end 32 to the distal ends 36 of the extensible members 28 and being blocked at its proximate end 30 by stationary parts of the chair, resides in a scrunched up state as shown in FIG. 2 or 4 just in front of the seat. This scrunched up fabric should not unduly interfere with user's legs as he or she sits in the chair. Of course, the telescopic members 22 may be set back from the edge of the seat 12 so that the scrunched up fabric in the retracted position does not extend past the edge of the seat. The user can move the leg rest 20 to the extracted position by simply grabbing the distal end 32 of the fabric 24 and extending it. Or, if the extensible members 28 have a handhold such as the thumbscrew 50, by loosening the thumbscrew and pushing it outward. As the extensible members 28 extend outwardly the fabric 24 also extends since the distal end 32 of the fabric 24 is fixed to distal ends 36 of the extensible portions 28 and the proximate end 30 of the fabric 24 is connected to a stationary part of the chair via the flexible members 40.

Likewise, the user can move the leg rest 20 to the retracted position by simply grabbing the distal end 32 of the fabric 24 and retracting it relative to the seat 12. Or, if the extensible members 28 have a handhold such as the thumbscrew 50, by loosening the thumbscrew and pushing it rearward. As the extensible members 28 retract the distal end 32 of the fabric 24 retracts causing the fabric 24 to scrunch up.

Figure 6:
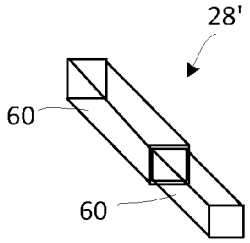
FIG. 6 is a perspective view of an alternative telescoping member, in isolation.

If desired, the extensible member 28 may be constructed from multiple nested telescoping components 60 as shown in an alternative extensible member embodiment 28' of FIG. 6. This will enable the length of the leg rest 20 in the extended position to be greater than the depth of the seat 12. In this example, each immediately adjacent pair of telescopic members can have a lost motion connection such as a captive pin/slot combination (not shown).

Figure 7:
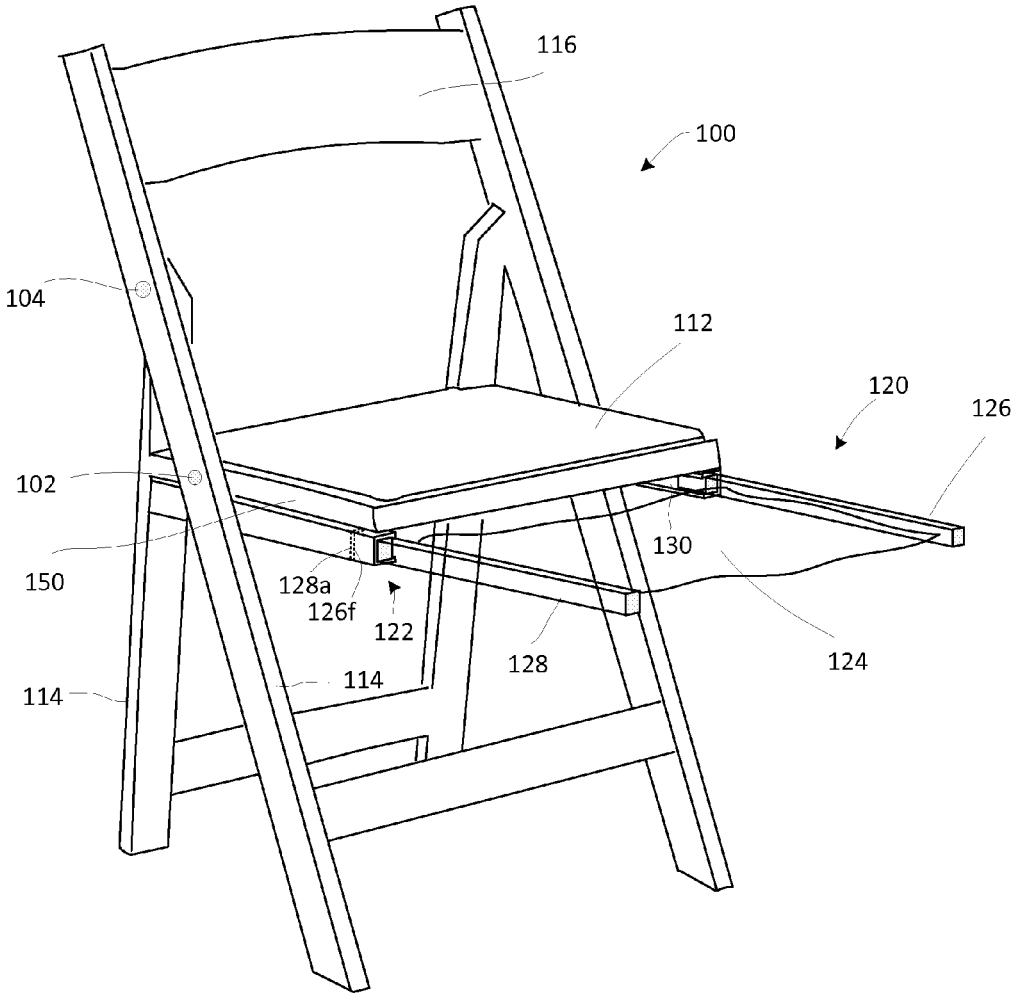
FIG. 7 is a perspective view of a folding chair with a leg rest in an extended position, according to a second embodiment.

FIG. 7 shows a chair 100 with a retractable leg rest 120 according to a second embodiment. The chair 100 in this example is a folding chair, which is articulated at leg joints 102 and leg/seat joints 104.

The chair 100 includes a conventional seat 112, legs 114 and a back 116. The seat 112 is situated generally along a first plane. The legs 114, which are connected to the seat 112, are disposed in two (or more) non-parallel planes that lie transverse to the first plane.

The retractable leg rest 120 includes two spaced apart telescoping members 122 with a fabric 124 extending between the telescoping members 122. Each telescoping member 122 has a tubular base portion 126 that is fixed to the seat 112 and/or rear legs and at least one extensible portion 128 that is slidably received in the tubular base portion 126 so as to extend from and retract into the tubular base portion 126. The telescoping members 122 are disposed along a third plane that lies transverse to both the two non-parallel second planes and, in this embodiment but not necessarily in other embodiments, parallel to the first plane.

The extensible portion 128 is retained in the tubular base portion 126, that is, when fully constructed the extensible portion 128 cannot be completely separated from the tubular base portion 126. This may be provided by a lost motion connection which in this embodiment is provided by an interferences between inner flanges **126*f* and 128*a* located at fore and aft portions of the tubular base portion 126 and extensible portion 128**, respectively.

The tubular base portion 126 of this embodiment is configured as U-channel, generally speaking, or more particularly having an elongate slit 130 along the complete length of an inside face of the base portion 126 in order to accommodate the fabric 124 as discussed in greater detail below. If desired each telescoping member 122 may have a slot/thumbscrew assembly (not shown) along an outwardly facing side of the telescoping member 122 for releasable locking the leg rest 120.

The fabric 124 in this embodiment is fixed at its periphery to the extensible portions 128. Any suitable fasteners may be employed such as stitching, nails, screws, adhesives, or hook and look fasteners.

In operation the leg rest 120 can be manually moved between retracted and extended positions.

The extended position is shown in FIG. 7. The user can move the leg rest 120 to the retracted position by simply grabbing the distal end of the fabric 124 and retracting it relative to the seat 112. Or, if the extensible members 28 have a handhold such as the thumbscrew, by loosening the thumbscrew and pushing it rearward. The extensible members 128 retract substantially into the tubular base portions 126. The fabric 124 is accommodated by the U-channel such that the fabric 124 retracts underneath the seat 112 and the whole leg rest 120 stows substantially under the seat.

Likewise, the user can move the leg rest 120 to the extracted position by simply grabbing the distal end of the fabric 124 and extending it. Or, if the extensible members 128 have a handhold such as the thumbscrew, by loosening the thumbscrew and pushing it outward.

If desired, the extensible members 128 may also be constructed from multiple nested telescoping components in order allow the length of the leg rest 120 in the extended position to be greater than the depth of the seat 112.

The leg rest 120 may be utilized in the non-foldable chair of the first embodiment and the leg rest 20 may be utilized in the foldable chair of the second embodiment.

The invention is not limited to the specific embodiments shown herein. For example, the telescoping members may be constructed more simply with sliding elements that have internal detents preventing their easy separation. Or, the sliding elements may have a friction fit therebetween. Likewise, although the telescopic members have been shown mounted directly underneath the seat in a plane parallel thereto, other alternatives are possible. For example, the telescopic members may be spaced apart from the seat and orientated in plane slightly transverse (e.g., 5-30 degrees) to the seat. This will provide a leg rest lower than the seat and slightly inclined thereto, which may be more comfortable ergonomically. Furthermore, although the telescoping members have been shown situated in between the legs, it is also possible to situate the telescoping members outside of the legs. As an additional alternative, it is also contemplated to form the seat longitudinal members (e.g., members 150 in FIG. 7) as tubular members, which function as the base portions of the telescoping members. There may also be more than two telescoping members.

The embodiments above have shown a releasable locking member in the form of a thumb screw, but alternative mechanisms may be deployed such as a spring loaded pin, detent mechanisms or hasps.

Those skilled in the art will appreciate that a variety of other modifications may be made to the embodiments discussed herein without departing from the scope of the invention as defined by the appended claims.

The invention claimed is:

1. A chair, comprising:

a seat, disposed generally along a first plane;

legs, connected to the seat, wherein the legs are disposed in at least two second planes orientated generally transverse to the first plane;

a retractable leg rest connected to at least one of the seat and legs, the leg rest having at least two spaced-apart telescoping members that are orientated in a third plane transverse to the at least two second planes, wherein each telescoping member includes a tubular base portion and at least one extensible member slidably received therein, and the tubular base portions are fixed to at least one of the seat and legs, the tubular base portions being disposed substantially under the seat and the at least one extensible member being substantially retractable into the corresponding base portions such that the leg rest stows substantially under the seat when in a retracted position and a fabric extending between the at least two spaced-apart telescoping members and partially slidable over the at least one extensible member, wherein the fabric has a proximate end adjacent the seat and a distal end remote from the seat, the fabric distal end is fixed to a distal end of the at least one extensible member and the fabric proximate end is connected to a stationary portion of the chair via a flexible member; and wherein the at least two spaced-apart telescoping members are extensible along the third plane to extend and retract the fabric relative to the seat.

2. A chair according to claim 1, wherein the third plane is orientated substantially parallel to the first plane.

3. A chair according to claim 1, wherein the tubular base portion and the at least one extensible member are coupled together via a lost motion connection.

4. A chair according to claim 3, wherein the lost motion connection is provided by a slot in one of the tubular base portion and the at least one extensible member and a pin connected to the other of the tubular base portion and the at least one extensible member, said pin being captive in said slot.

5. A chair according to claim 4, wherein said slot is an elongate slot in the tubular base portion, said pin is a thumbscrew in the at least one extensible member and is operatively connected thereto, and wherein said thumbscrew rides in the elongate slot.

6. A chair according to claim 1, wherein the at least one extensible member includes multiple nested telescoping components.

7. A chair according to claim 1, wherein the fabric includes sleeves that contain the at least one extensible members.

8. A chair according to claim 1, wherein the fabric scrunches up when the at least one extensible member is retracted and the fabric spreads out when the at least one extensible member is extracted.

9. A chair according to claim 1, wherein the fabric is fixed to the at least one extensible member.

10. A chair according to claim 9, wherein the tubular base portion includes a channel for accommodating the fabric when the at least one extensible member is retracted.

11. A chair according to claim 1, wherein the tubular base portions of the at least two spaced apart telescoping members are fixed to at least one of the seat and the legs.

12. A chair according to claim 1, wherein the at least two spaced apart telescoping members include releasable locking mechanisms.

13. A chair, comprising:

a seat, disposed generally along a first plane;

legs, connected to the seat, wherein the legs are disposed in at least two second planes orientated generally transverse to the first plane;

a retractable leg rest connected to at least one of the seat and legs, the leg rest having at least two spaced-apart telescoping members that are orientated in a third plane transverse to the at least two second planes, wherein each telescoping member includes a tubular base portion and at least one extensible member slidably received therein, and a fabric extending between the at least two spaced-apart telescoping members and fixed to the at least one extensible members, wherein the at least two spaced-apart telescoping members are extensible along the third plane to extend and retract the fabric relative to the seat, and wherein the tubular base portions are fixed to at least one of the seat and legs, the tubular base portions being disposed substantially under the seat and the at least one extensible members being substantially retractable into the corresponding tubular base portions such that the leg rest stows substantially under the seat when in a retracted position and the tubular base portion includes a channel for accommodating the fabric when the at least one extensible member is retracted.

* * * * *